United States Patent [19]

Burgio di Aragona

[11] Patent Number: 4,517,936

[45] Date of Patent: May 21, 1985

[54] TAPPET FOR INTERNAL COMBUSTION ENGINES WITH VARIABLE PROFILE CAMSHAFTS

[75] Inventor: Antonio Burgio di Aragona, Moncalieri, Italy

[73] Assignee: Fiat Auto S.p.A., Turin, Italy

[21] Appl. No.: 541,180

[22] Filed: Oct. 12, 1983

[30] Foreign Application Priority Data

Oct. 12, 1982 [IT] Italy ..... 68194 A/82

[51] Int. Cl.[3] ..... F01L 1/14

[52] U.S. Cl. ..... 123/90.5; 123/90.17

[58] Field of Search ..... 123/90.48, 90.5, 90.17

[56] References Cited

U.S. PATENT DOCUMENTS 2,733,619 2/1956 Smith ..... 123/90.48 X 4,335,685 6/1982 Clouse ..... 123/90.5

FOREIGN PATENT DOCUMENTS 161907 12/1980 Japan ..... 123/90.48

*Primary Examiner*—William R. Cline

*Assistant Examiner*—Peggy A. Neils

*Attorney, Agent, or Firm*—Sughrue, Mion, Zinn, Macpeak and Seas

[57] ABSTRACT

A tappet for use in internal combustion engines having variable-profile camshafts comprises an oscillating sliding block with a flat surface for contact with a cam, a bearing saddle for the block having anti-rotation guides, and a cup with shoulders for retaining the bearing saddle.

1 Claim, 2 Drawing Figures

TAPPET FOR INTERNAL COMBUSTION ENGINES WITH VARIABLE PROFILE CAMSHAFTS

The present invention relates to tappets for internal combustion engines using variable-profile camshafts, comprising an oscillating sliding block, a bearing saddle for the block, and a cup.

Camshafts with variable-profile cams are used in modern engines to allow the lift and the opening periods of the valves to be varied in dependence on the rotational speeds of the engines, in order to optimise the performance and fuel consumption.

With this type of camshaft, the contact line between a tappet and the corresponding cam never lies in a plane perpendicular to the axis of the tappet, as in the case of a fixed-profile chamshaft, but at an angle thereto which varies with a change in the longitudinal position of the cam relative to the tappet.

This necessitates the provision of a type of tappet which allows such variations without being so complicated or heavy as to give rise to other disadvantages.

Tappets are known in the prior art in which the part in contact with the surface of the cam is constituted by a ball or roller which allows the angular variations by having very small areas of contact with the cam.

These tappets have very short working lives compared with the average life of an engine, however, in that they must withstand the loads of the valve springs which are effectively very high at a single point.

Consequently, both the surface of the roller or ball and particularly the surface of the cam must be subjected to a specific hardening treatment which is still not sufficient for the purpose although being very expensive.

The object of the present invention is to provide a tappet which allows this disadvantage to be overcome.

This object is achieved by means of a tappet which comprises:

an essentially rectangular sliding block having a flat rectangular surface for contact with a cam and, on its surface opposite the contact surface, a projection of part-circular section which extends coaxially along the entire major axis of the block;

an elongated bearing saddle for the block, having in its upper surface a seat which is coaxial with its major axis and is engageable by the projection of the sliding block and two semi-cylindrical guides disposed centrally on opposite sides to prevent rotation of the saddle about a valve axis in use, and a cylindrical cup having, on its upper surface, two tabs which define a receiving seat for the bearing saddle and, in use, withstand the thrust generated by the sliding of the cam on the sliding block, and a cylindrical seat for receiving discs of different thickness for the adjustment of the tappet.

Figure 1:
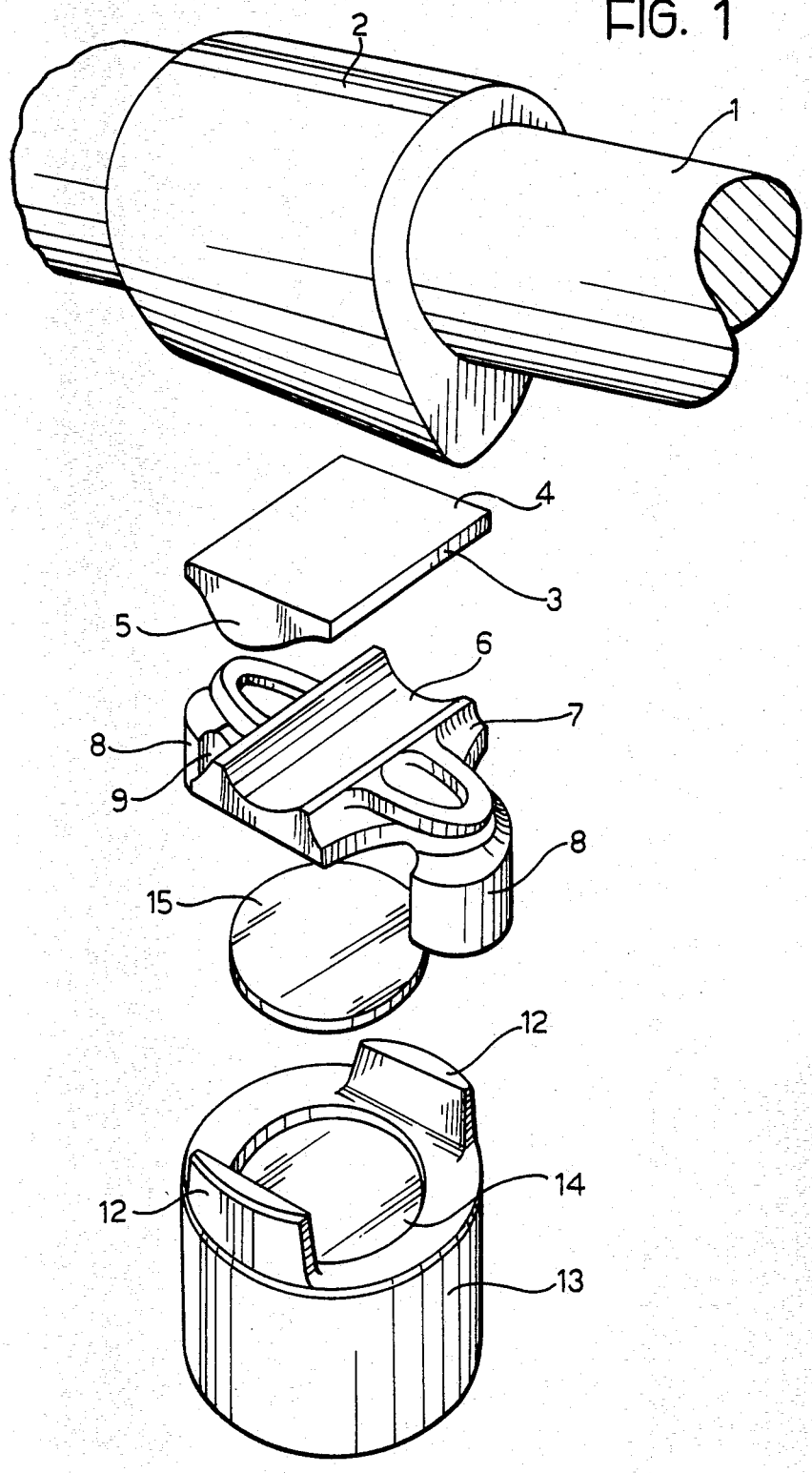
Figure 2:
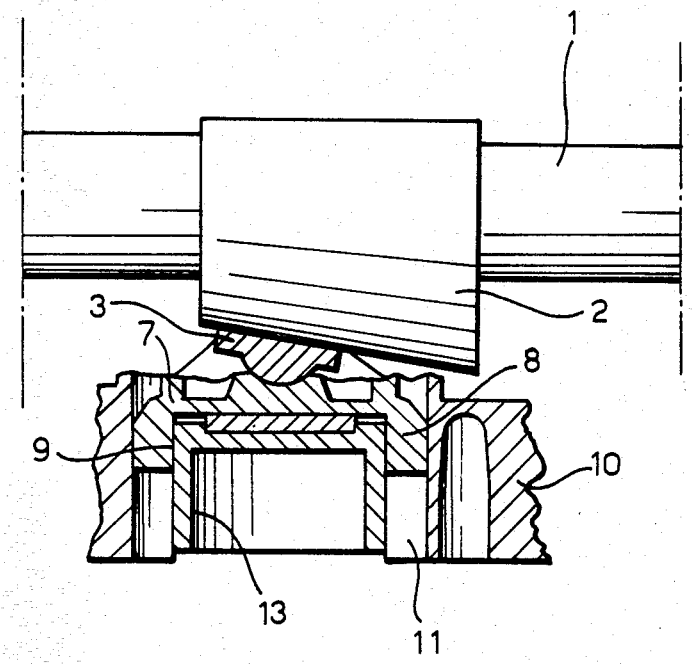

One embodiment of the invention will now be described in detail, by way of non-limiting example, with reference to the appended drawings, in which:

FIG. 1 is an exploded perspective view of a tappet according to the present invention, and FIG. 2 is a sectional view of the tappet of FIG. 1 installed in the head of an engine.

With reference to the drawings, a camshaft 1 has variable-profile cams 2, one of which is shown, for controlling the opening and closure of the valves of an internal combustion engine. The cam 2 acts on a respective valve (not shown) through a tappet.

The tappet includes an essentially rectangular sliding block 3 with a flat upper surface 4 for contact with the cam 2. The lower surface of the block 3 has a projection 5 of partcircular section which extends coaxially along the entire major axis of the block 3. The projection 5 rests in a correspondingly-shaped seat 6 formed in the upper surface of a bearing saddle 7 for the block 3.

The engagement of the projection 5 in the seat 6 allows the block 3 to rotate about its longitudinal axis and enables the contact surface 4 to follow the variations in inclination along the profile of the cam 2.

The bearing saddle 7 itself is formed essentially with an elongated central portion having a major axis parallel to the major axis of the block 3 and has two semi-cylindrical guides 8 disposed centrally on opposite sides and projecting downwardly. The guides 8 have flat side walls 9 which face inwardly and are parallel to the major axis of the saddle 7. On assembly of the head 10 of the engine, the semi-cylindrical guides 8 are inserted in semi-cylindrical sliding seats 11 formed in the head 10 by broaching, so as to prevent the bearing saddle 7 from rotating about its axis.

The bearing saddle 7 is inserted longitudinally between two tabs 12 formed on the upper surface of a cylindrical cup 13 which acts as a receiving seat. The tab 12 discharge both the axial and rotational thrusts imparted to the saddle 7 by the action of the cam 2 on the block 3, since the inner walls 9 of the guides 8 which embrace the side wall of the cup 13 are flat and do not bear on the cup itself, as a result of the minimum rotational movement allowed by the working tolerances between the parts 3,7, 13 of the tappet.

The upper surface of the cup 13 also defines a seat 14 for receiving one 15 of a number of discs of different thicknesses which allow the play of the tappet to be adjusted.

The tabs 12 have a slight inward curvature relative to the side wall of the cup, so as to allow a bevel to be formed on the upper edge of the cup 13 by turning.

What is claimed is:

1. A tappet for engines with variable-profile cam shafts comprising:

a substantially rectangular sliding block having a flat surface for contact with a cam and a projection of part-circular section on the surface thereof opposite to said flat surface which extends parallel to the major axis of said block;

a bearing saddle for said sliding block comprising an elongated central portion having a major axis parallel to the major axis of said block with an elongated groove in the upper surface of said central portion parallel to the major axis thereof receiving said projection of said sliding block and having two semi-cylindrical guides disposed on opposite sides of said saddle portion fo engagement with complementary seats in an engine head to prevent rotation of said saddle about a valve axis;

a cylindrical cup having an upper surface with two spaced apart tabs protruding axially therefrom to define a seat for receiving said bearing saddle for withstanding the thrust generated by the sliding of the cam on said sliding block and a cylindrical seat disposed between said tabs; and tappet adjustment means engageable in said cylindrical seat of said cup.

* * * * *